US006499232B2

(12) United States Patent
Bielfeldt

(10) Patent No.: US 6,499,232 B2
(45) Date of Patent: Dec. 31, 2002

(54) METHOD AND APPARATUS FOR REDUCING THE MOISTURE BOUND BY CAPILLARY ACTION IN FIBER CELLS

(75) Inventor: Friedrich B. Bielfeldt, Pähl (DE)

(73) Assignee: Maschinenfabrik J. Dieffenbacher GmbH & Co, Eppingen (DE)

( * ) Notice: Subject to any disclaimer, the term of this patent is extended or adjusted under 35 U.S.C. 154(b) by 25 days.

(21) Appl. No.: 09/828,468

(22) Filed: Apr. 9, 2001

(65) Prior Publication Data

US 2002/0000416 A1 Jan. 3, 2002

(30) Foreign Application Priority Data

Apr. 9, 2000 (DE) ..... 100 16 944

(51) Int. Cl.[7] ..... F26B 3/08

(52) U.S. Cl. ..... 34/384; 34/400; 34/417; 34/60; 34/167; 34/208

(58) Field of Search ..... 34/208, 312, 315, 34/316, 318, 323, 327, 360, 359, 363, 423–425, 147, 179, 182, 221–226, 60, 384, 400–417, 167; 110/244, 245

(56) References Cited

U.S. PATENT DOCUMENTS

| | | | | | |
|---|---|---|---|---|---|
| 4,330,411 | A | * | 5/1982 | Florin et al. | 110/346 |
| 4,702,745 | A | * | 10/1987 | Kamei et al. | 34/329 |
| 4,722,789 | A | * | 2/1988 | Kupka | 100/198 |
| 4,906,369 | A | * | 3/1990 | Bahr | 100/118 |
| 4,970,803 | A | * | 11/1990 | Keller | 110/224 |
| 5,051,194 | A | * | 9/1991 | Bahr | 210/386 |
| 5,215,670 | A | * | 6/1993 | Girovich | 209/659 |
| 5,227,073 | A | * | 7/1993 | Bastgen et al. | 210/710 |
| 5,309,849 | A | * | 5/1994 | Krebs | 110/224 |
| 5,426,866 | A | * | 6/1995 | Rumocki | 210/609 |
| 5,573,667 | A | * | 11/1996 | Benesi | 100/198 |
| 5,611,935 | A | * | 3/1997 | Thiemann et al. | 110/245 |
| 5,645,614 | A | * | 7/1997 | Dummersdorf et al. | 100/37 |
| 5,762,980 | A | * | 6/1998 | Bielfeldt | 425/371 |
| 5,775,004 | A | * | 7/1998 | Steier et al. | 34/424 |
| 5,862,612 | A | * | 1/1999 | Bielfeldt | 210/770 |
| 5,887,514 | A | * | 3/1999 | Bielfeldt et al. | 100/118 |
| 5,900,139 | A | * | 5/1999 | Bielfeldt | 100/118 |
| 5,960,559 | A | * | 10/1999 | Brunnmair et al. | 110/216 |
| 6,161,305 | A | * | 12/2000 | Maier et al. | 34/221 |
| 6,280,638 | B1 | * | 8/2001 | Belchev | 210/196 |

FOREIGN PATENT DOCUMENTS

| | | | | |
|---|---|---|---|---|
| DE | 19940392 A1 | * | 3/2001 | B01D/33/04 |
| EP | 0 360 273 A2 | * | 3/1990 | B01D/25/12 |
| GB | 2 031 293 A | * | 4/1980 | B01D/33/04 |
| GB | 2 257 640 A | * | 1/1993 | B01D/33/052 |
| GB | 2 305 436 A | * | 4/1997 | C10F/5/04 |
| JP | 59-213418 A | * | 12/1984 | B01D/25/12 |
| WO | WO 87/02908 A1 | * | 5/1987 | B01D/25/12 |

* cited by examiner

*Primary Examiner*—Ira S. Lazarus
*Assistant Examiner*—Andrea M. Ragonese
(74) *Attorney, Agent, or Firm*—Foley & Lardner

(57) ABSTRACT

A method and an apparatus for reducing the moisture content bound by capillary action in fiber cells. To include fine material economically and easily in the process, coarse material is sandwiched on top of fine material and then pressed and dried. The material prepared by grinding and screening is transferred as coarse material to a first spreader hopper, and the screened fine material is transferred over a chute and conveyor belt to a second spreader hopper. The fine material is spread in a thin layer through a vertically adjustable gate from the second spreader hopper onto a spreading, loading and filtering belt, and the coarse material is withdrawn on a transfer conveyor belt running below the first spreader hopper and then is spread through a vertically adjustable gate onto the fine layer, to form a sandwich-like mat.

7 Claims, 1 Drawing Sheet

METHOD AND APPARATUS FOR REDUCING THE MOISTURE BOUND BY CAPILLARY ACTION IN FIBER CELLS

The German priority document, DE 100 16 944.9, filed Apr. 9, 2000 is hereby incorporated by reference.

FIELD OF THE INVENTION

The invention relates to a method for reducing the moisture bound by capillary action in fiber cells in solids and/or sludges, especially raw brown coal, containing carbon, ground and screened to form a mat of outspread material, by the action of thermal energy and pressure on the input material that is to be dewatered, wherein the thermal energy comprising hot water and saturated steam and the mechanical energy as surface pressure on the input material is fed into and exercised on a pressure chamber of a filter press. The fiber cells may be cells of finely communited solid materials. The invention also relates to an apparatus for practicing that method. In the discontinuous embodiment, the spreading, loading and filtering belt passes through the press discontinuously in cyclical operation.

BACKGROUND OF THE INVENTION

With regard to the former sieve method of processing the material to be dewatered, the principal application DE 199 40 392, which is hereby incorporated by reference, described the problem that the fine material screened out (fine material that exceeded the critical percentage of about 10%, up to about 35%, residual fine material content in the total material) could not be returned to the mechanical/thermal dewatering (MTE) process. The method and apparatus of the principal application addressed this problem.

In the apparatus according to the principal application, a disadvantage is found in the case of very great bulk weights, which results from the height of the hopper system for the coarse material. Because of the weight of the column of material coming from the high coarse material hopper (about 10 to 15 m high), the fine material layer (which comes from the fine material hopper) spread out underneath it is so greatly compressed (up to about 10 bar) that, as the process continues, the resistance to permeation by the process water and steam within the MTE pressure chamber is too high. When the height of the coarse material in the coarse material hopper is very high, the entire process is hindered.

There is an additional problem resulting from the high pressure in the material from the coarse material hopper. A controlled two-layer spread is no longer possible, because the entry of the fine material layer from the metal mesh belt is blocked in the direction of movement under the coarse material layer by the bulk material pressing down upon it from above.

SUMMARY OF THE INVENTION

The invention addresses the problem of improving the method and the apparatus according to the principal application DE 19940 392 such that the disadvantages set forth above are avoided and a trouble-free operation of the process is assured.

The solution regarding the method is achieved by the following process steps:

First, the input material is processed by grinding and screening the material and then feeding it into two spreader hoppers according to grain size and screened grain size distribution. The coarse material, thus separated, is fed to a first spreader hopper, and contains only a measured residue of fine material below the critical permeability limit. At the same time, the fine material, thus separated, with a grain size under 3 mm, is delivered to a second spreader hopper. Then, from the second spreader hopper (which precedes the first spreader hopper for the coarse material) a thin layer of fine material is spread onto a spreading, loading and filtering belt as a first layer. Then, from the first spreader hopper, a substantially thicker coarse material layer is drawn off by a transfer conveyor belt and then applied as a second layer over the fine material layer to form a "sandwich" mat. Lastly the sandwich mat is brought by the spreading, loading and filtering belt into the MTE pressure chamber of the filter press for the dewatering cycle. Meanwhile, the pressed dry material is carried away.

The solution for the apparatus includes the following:

An arrangement of an input hopper and two material hoppers in tandem, wherein the material, already processed by grinding and screening, is fed as coarse material into a first spreader hopper. The screened-out fine material can be transferred over a chute and conveyor belt into a second spreader hopper, in which the fine material can be spread from the second spreader hopper onto the spreading, loading and filtering belt in a thinner layer, after passing through a vertically adjustable sliding gate. The coarse material can be transferred from the first hopper, initially onto a transfer belt running beneath it, and laid in a thick layer, after passing through a vertically adjustable gate, onto the fine material layer to form a sandwich mat of the outspread material.

The arrangement of a transfer belt for the coarse material is an advantage of the invention, whereby the entire weight of the bulk material column from the coarse material hopper is supported on the transfer conveyor belt. The necessary mass of material is controlled by the depth regulator, which depends on the bulk material depth and the final depth of the two-layer spread. Experiments have shown that, with a depth arrangement of $H_F$ and $H_C$ (fine material depth to coarse material depth) the method and apparatus herein described are advantageous.

The method and the apparatus according to the invention can be used both for a cyclic MTE process and for a continuous MTE process. Moreover, two embodiments could be used alternatively as continuous presses: the first is an embodiment similar to a continuously operating two-belt press with lateral pressure chamber walls between which an upper and lower endless metal mesh belt runs; the second embodiment is a roll press as a roll stand with a plurality of rolls arranged in tandem, which likewise are sealed off by corresponding lateral chamber walls to form a pressure chamber. In the first and second embodiments, the spreading, loading and filtering belt circulates both through the coarse and fine hopper system and through the pressure chamber.

BRIEF DESCRIPTION OF THE DRAWING

Additional advantageous measures and embodiments of the subject of the invention will be found in the subordinate claims and in the following description with the drawing, in which

DETAILED DESCRIPTION OF THE PREFERRED EMBODIMENT

Figure 1:
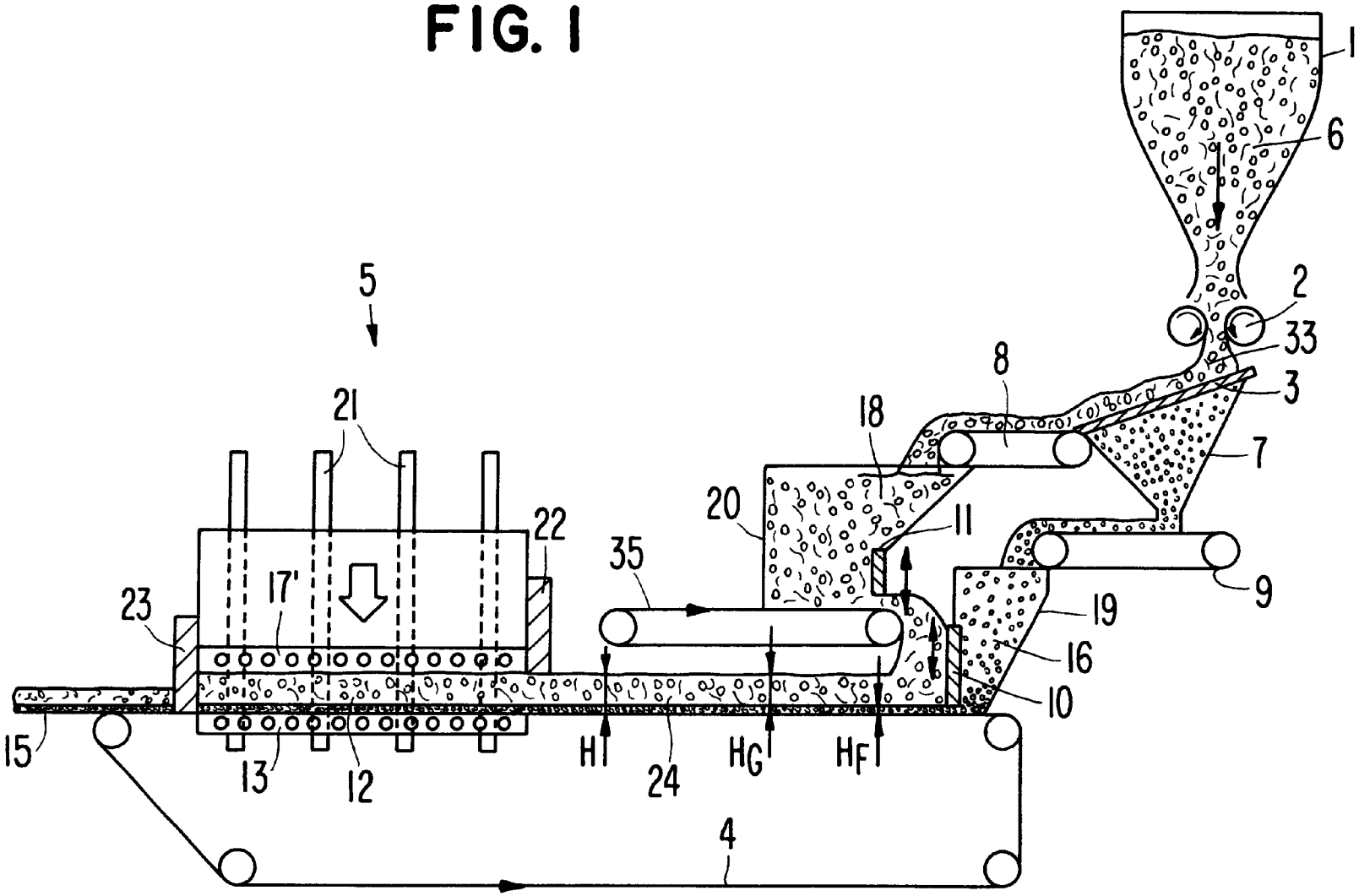
FIG. 1 is a side view of the apparatus according to one embodiment of the present invention.

The drawing shows the apparatus for the practice of the method of the invention, from the side, with the input material hopper 1, the breaker mill 2, the sieve belt system 3, the hopper 20 for the coarse material 18, the hopper 19 for the fine material 16, and the filter press 5. The input material 6 is stored in the input material hopper 1 and is drawn down by the breaker mill 2 and is fed over the sieve system 3 and the chute 7 as well as the conveyor belts 8 and 9 to the hopper 20 for the coarse material 18 or to the hopper 19 for the fine material 16. In the sieve system 3, a quantitative separation of the fine material 16 from the ground input material 6 is made, so that the coarse material 18 contains only a measured residual content of fine material 16 below the critical permeability limit. A controlled-frequency shaking-vibrating screen or ultrasound screen can be used as the screening system 33, whereby fine material in the range of 0 to 3 mm are screened out at a controlled rate.

The coarse material 18, in an optimum MTE grain size distribution, and the fine material 16, are fed from the hopper 20 and hopper 19, respectively, onto the spreading, loading and filtering belt 4 made out of metal mesh. Appropriately, hopper 19 is arranged ahead of hopper 20 and thus is the first to form a thin layer $H_F$ of fine material on the spreading, loading and filtering belt 4. To draw off the coarse material 18 a transfer conveyor belt 35 is provided under hopper 20. The coarse material 18 is then spread onto the layer $H_F$ of fine material by the transfer conveyor belt 35 in a depth $H_C$. The depths $H_F$ and $H_C$ are controlled by adjustable gates 10 and 11, respectively, so as to be best for the process. After each dewatering cycle the MTE pressure chamber 12 is opened, along with the controlled inlet lock 22 and outlet lock 23. Then, the spreading, loading and filtering belt 4 is advanced so that the already pressed dry material 15 can be unloaded while the sandwiched mat 24 is simultaneously loaded.

The filter press 5 includes press frames 21, MTE compression chamber 12 with a steam and hot water distribution system, and lock system. The thermal process is initiated by upper press plate 17, which uses high-pressure steam (16 to 24 bar) to force hot water (200–220° C.) through the sandwich mat and through the spreading, loading and filtering belt to the stationary press plate 13 below. The spreading, loading and filtering belt is permeable to water for that purpose, and comprises a metal wire mesh. The sandwich mat cools the water, and the cold process water is removed through the lower press plate 13 during the thermal pressing process. In the mechanical pressing process the moving upper press plate 17 presses against the stationary press plate 13. The drawing furthermore shows the depth ratios of coarse layer $H_C$ to fine layer $H_F$ with the total depth H.

Although the aforementioned described various embodiment of the invention, the invention is not so restricted. The foregoing description is for exemplary purposes only and is not intended to be limiting. Accordingly, alternatives which would be obvious to one of ordinary skill in the art upon reading the teachings herein disclosed, are hereby within the scope of this invention. The invention is limited only as defined in the following claims and equivalents thereof.

What is claimed is:

1. Method for the reduction of the water content bound by capillary action in fiber cells in solids and/or sludges, ground and screened to form a mat of spread material, by the action of thermal energy and pressure on the input material that is to be dewatered, wherein the thermal energy comprising saturated steam and the mechanical energy as surface pressure on the input material is fed into and exercised on an MTE pressure chamber of a filter press, characterized by the following process steps:

processing the input material separately by grinding and screening the input material and then feeding it into a plurality of spreader hoppers depending on grain size and screened grain size distribution, wherein coarse material, thus separated, is fed to a first spreader hopper, which contains only a residue of fine material below a permeability limit; and wherein the fine material, thus separated, with a grain size under 3 mm, is simultaneously fed into a second spreader hopper;

from the second spreader hopper, which precedes the first spreader hopper for the coarse material, spreading a thin layer of fine material as a first deposit onto a spreading, loading and filtering belt;

withdrawing by a transfer conveyor belt, from the first spreader hopper, a substantially thicker coarse material layer and then laying that coarse material layer as a second deposit onto the fine material layer to form a sandwich mat of spread material;

moving the sandwich mat by the spreading, loading and filtering belt into the MTE pressure chamber of the filter press for dewatering; and taking out pressed dry material from the filter press.

2. Method according to claim 1, wherein the method is performed continuously.

3. Method according to claim 1, wherein the method is performed discontinuously.

4. An apparatus for reducing moisture bound by capillary action in an input material, the apparatus comprising:

an input material hopper;

a breaker mill adapted to grind the input material;

a sifting device adapted to sift the material into a first spreader hopper for coarse material and, by way of a chute and conveyor belt, into a second hopper for screened-out fine material;

a second vertically adjustable gate adapted to spread the fine material from the second spreader hopper onto an endless spreading, loading and filtering belt;

a transfer conveyor belt adapted to withdraw coarse material from the first spreader hopper;

a first vertically adjustable gate adapted to spread the coarse material from the transfer conveyor belt onto the fine material spread from the second spreader hopper to form a sandwich mat;

a heatable filter press, including an MTE pressure chamber which is adapted to be closed in a gas-tight and pressure-tight manner, and which is adapted to press and dry the sandwich mat.

5. The apparatus according to claim 4, wherein the spreading, loading and filtering belt is adapted to pass discontinuously through the filter press in a cyclical operation.

6. Apparatus according to claim 4, wherein the filter press operates continuously, and wherein the filter press comprises:

a continuously operating double-belt press; and lateral pressure chamber walls between which an upper and lower endless metal mesh belt is adapted to run.

7. Apparatus according to claim 4, wherein the filter press operates continuously, and wherein the filter press comprises:

a roller frame press with a plurality of rollers in tandem; and lateral pressure chamber walls between which an upper and lower endless metal mesh belt is adapted to run.

* * * * *